US012685354B2

(12) United States Patent
Kim et al.

(10) Patent No.: US 12,685,354 B2
(45) Date of Patent: Jul. 21, 2026

(54) WRAP-AROUND, IMPACT FORCE ABSORBING, PADDED, HEAD-IMPACT PROTECTING HEADBAND AND HELMET LINER

(71) Applicants: Armand F. Lewis, Mattapoisett, MA (US); Stephen H. Kim, North Dartmouth, MA (US)

(72) Inventors: Yong K Kim, North Dartmouth, MA (US); Armand F. Lewis, Mattapoisett, MA (US)

(73) Assignee: UNIVERSITY OF MASSACHUSETTS, Boston, MA (US)

( * ) Notice: Subject to any disclaimer, the term of this patent is extended or adjusted under 35 U.S.C. 154(b) by 1 day.

(21) Appl. No.: 18/824,186

(22) Filed: Sep. 4, 2024

(65) Prior Publication Data

US 2025/0113886 A1 Apr. 10, 2025

Related U.S. Application Data

(60) Provisional application No. 63/543,356, filed on Oct. 10, 2023.

(51) Int. Cl.
*A41D 20/00* (2006.01)
*A42B 3/12* (2006.01)

(52) U.S. Cl.
CPC ..... *A41D 20/00* (2013.01); *A42B 3/125* (2013.01)

(58) Field of Classification Search
CPC ..... A41D 20/00; A42B 1/08; A42B 3/127
See application file for complete search history.

(56) References Cited

U.S. PATENT DOCUMENTS 4,521,922 A * 6/1985 Mitchell ..... A41D 20/005 2/DIG. 11
4,646,367 A * 3/1987 El Hassen ..... A42B 3/00 2/412
4,698,852 A * 10/1987 Romero ..... A42B 3/00 2/909
5,377,360 A * 1/1995 Fleitman ..... A41D 20/00 2/DIG. 11
5,745,921 A * 5/1998 Mitchell ..... B32B 5/26 2/DIG. 11
5,768,715 A * 6/1998 Gregg, III ..... A42B 3/00 2/421
5,963,989 A * 10/1999 Robertson ..... A63B 71/10 2/DIG. 11
6,227,011 B1 * 5/2001 Cortinovis ..... A41D 20/00 66/8
6,397,399 B1 * 6/2002 Lampe ..... A63B 71/10 2/171.2

(Continued)

*Primary Examiner* — Tajash D Patel
(74) *Attorney, Agent, or Firm* — Armis IP Law

(57) ABSTRACT

An impact protecting device includes flocked energy absorbing material (FEAM) impact force absorbing (IFA) segments. Each segment includes a double-sided flock section; a segment cover disposed covering the double-sided flock section and an outer elastic cover enclosing the plurality of FEAM IFA segments including stitching to keep the segments adjacent to adjoining segments but separated. The device further includes overlapped segments to provide extra head protection for the forehead and frontal head areas.

9 Claims, 13 Drawing Sheets

(56) References Cited

U.S. PATENT DOCUMENTS

| | | | | |
|---|---|---|---|---|
| 6,493,881 | B1 * | 12/2002 | Picotte | A42B 3/121 2/413 |
| 7,937,778 | B1 * | 5/2011 | Norton | A42B 1/08 2/175.4 |
| 10,080,394 | B2 * | 9/2018 | Johnston | A42B 1/08 |
| 2016/0286888 | A1 * | 10/2016 | Abraham | A42C 5/02 |
| 2019/0014839 | A1 * | 1/2019 | Johnston | A41D 20/00 |
| 2019/0075878 | A1 * | 3/2019 | Abraham | B32B 3/266 |
| 2023/0040930 | A1 * | 2/2023 | Olivares Velasco | A41D 13/015 |

* cited by examiner

WRAP-AROUND, IMPACT FORCE ABSORBING, PADDED, HEAD-IMPACT PROTECTING HEADBAND AND HELMET LINER

RELATED APPLICATIONS

This application claims the benefit of Provisional Application Ser. No. 63/543,356 entitled WRAP-AROUND, IMPACT FORCE ABSORBING, PADDED, HEAD-IMPACT PROTECTING HEADBAND AND HELMET LINER filed Oct. 10, 2023 which application is hereby incorporated herein by reference in its entirety.

FIELD OF USE

The present disclosure relates to protective headbands and helmet liners.

BACKGROUND

There are several headbands on the market that claim to be "Protective Headbands." Most of these headbands involve the concept of enveloping linear sections/strips of a closed cell, Impact Force Absorbing (IFA) foam (like Vinyl Nitrile, neoprene, or other foams) in a stretchable (Spandex containing) cover fabric. Some of these existing "products" are (a) pre-sized unitary, pull-over the head configurations, and others are (b) Wrap-Around (adjustable) headband structures the employ sewn-in Velcro® Hook and Loop strips that serve as the Stretch around head, head lock-on feature. Most of these present designs are flawed using non-stretchable strips of foam that constitute the perimeter part of the protective headband. These strips of closed cell foam are stiff and do not at all conform to the head on contact. Most of these designs have minimal elastic stretch-ability. Also, such a material combination is very poor in moisture (sweat) absorption. While they may IFA protect the head, they are uncomfortable and bulky. Many of these commercially available IFA headbands are of complex and convoluted design; and many of these complex design headbands are expensive. Many types of polymeric based materials are used in the fabrication of moderate to thin cross-section IFA sport head and body protection padding structures, however these devices do not provide adequate protection.

SUMMARY

Flocked Energy Absorbing Material (FEAM) Impact Force Absorbing (IFA) structures have been found to be effective IFA materials for Sport, Military and Civil Servant apparel and equipment applications. A FEAM employing Wrap-Around Padded Headband (WAPH) concept has been devised whereby wrap-around head conformability, good stretch-ability, IFA and wearer comfort has been achieved. The inventors of the present application have discovered a surprising method for increasing the IFA properties of the FEAM structures as described below.

Various embodiments described below include a wrap-around impact protecting device includes flocked energy absorbing material (FEAM) impact force absorbing (IFA) segments. Each segment includes a double-sided flock section; a segment cover disposed covering the double-sided flock section and an outer elastic cover enclosing the plurality of FEAM IFA segments including separators to keep the segments adjacent to adjoining segments but separated.

In a further embodiment, each segment has an approximate parallelogram shape; and the separation of the outer elastic cover enclosing the plurality of FEAM IFA segments has diagonal separation corresponding approximate parallelogram shape of the segments, and the outer elastic cover includes a closure system for keeping the device adjacent to a wearers head. In another embodiment, adjacent, proximal ends of the approximate parallelogram shape segments are at a 45-degree angle with respect to a base of the segment (diagonal-stitched circular assembly of adjacently positioned segments).

In yet another embodiment double sided flock sections include flock fibers having a denier in a range of about 40 denier to about 100 denier and a length between about 2 mm to about 4 mm.

In other embodiments, the segment cover comprises microsuede fabric; the impact protecting device is a head-impact protecting device; and the headband includes at least one over the head FEAM strap that is attached to head-impact protecting device. In still other embodiments, the segment cover comprises a fabric. In other embodiments, the segment separators include stitching; adhesive bonding; and thermal bonding. In another embodiment the wrap-around impact protecting device includes a distinctive logo.

The uniqueness of the inventive headband is based on the following special features: employing FEAM as the IFA providing material component assures the headband will have excellent breathability, sweat and heat managing and IFA properties; and the headband is soft, wearer conformable and very comfortable.

The FEAM components are encapsulated in individual compartments diagonally shaped and diagonally sewn or sealed compartments in the peripheral span of the belt-like span of the headband (perimeter) structure. These diagonally sewn segment divider zones result in headband stretchability. FEAM by itself is not very stretchable. The diagonal slant to the between FEAM encapsulated segment has a purpose. It serves to keep some IFA FEAM material available along the complete 360 degrees of perimeter head coverage of the headband.

DESCRIPTION OF THE DRAWINGS

The foregoing and other objects, features and advantages of the invention will be apparent from the following more particular description of embodiments of the invention, as illustrated in the accompanying drawings and figures in which like reference characters refer to the same parts throughout the different views. The drawings are not necessarily to scale, with emphasis instead being placed upon illustrating the embodiments, principles and concepts of the invention. These and other features of the invention will be understood from the description and claims herein, taken together with the drawings of illustrative embodiments, wherein:

DETAILED DESCRIPTION

Figure 1:
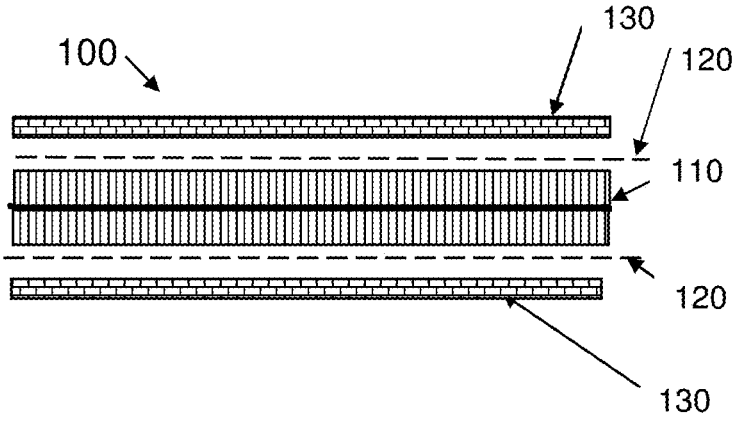
FIG. 1 is a schematic diagram of three-component IFA body-protection pad structure in accordance with one example embodiment disclosed herein.

Improved Impact Force Absorption (IFA) treated flock structures are provided, in one embodiment, by structures including flocked energy absorbing material (FEAM) impact force absorbing (IFA) segments. At least two factors are responsible for the enhanced IFA properties: (a) the increase in frictional properties and enhanced inter-fiber entanglement of the flock fiber when these fibers are deformed during compression "impact" straining, and (b) the overlapped segments of the FEAM material.

Headbands are a ubiquitous part of societal head garments. Headbands cover a wide application area from fashion, hair management (for women) to protective and sweat-managing headbands for sport and military applications. The subject invention fits into the sport and military application area. There are many forms and designs of sport-related protective headbands on the market today. None of these commercially available protective headbands involve combining FEAM IFA technology with the uniqueness of stretchable and Velcro® hook adaptable fabric.

This combination of materials is ideal for creating simple-design IFA protective headband applications. WAPHs have superior performance and wearer comfort properties at a reasonable cost. The outer covering of the WAPH headband configurations is composed of a stretchable (Spandex® containing) soft-to-the-touch fabric that has inherent Velcro® hook adaptability. Such a smoothly stretchable (elastic)/Velcor®, hook adaptable fabric is commercially available from Gehring-Tricot, Garden City, NY (WW-1373)

Impact Force Absorption (IFA) studies on three-component Flocked Energy Absorbing Material (FEAM) configurations are carried out relative to their potential use in sport sweatband, headband and body impact protection pad applications. This study was limited to evaluating IFA pad entities of under 12.7 mm (0.5") thickness. Here, three-component "generic" FEAM pad designed test panels were fabricated and IFA evaluated. The primary configuration of study was an assembly of planar elements composed of Velcro® hook adaptable outer fabric (VelTex® or Gehring-Tricot's WW1373 or WW1733 fabric) layers on both sides of a divider/spacer fabric enveloped, double-side flocked with 20 to 100 denier, 2 mm (0.08") to 4 mm (0.12") long, nylon, FEAM element "core". This configuration is found to be the simplest and best thinner cross-section IFA performing FEAM employing IFA pad design. This FEAM configuration was first applied to creating Hockey Goalie inside-the-helmet Sweatbands. IFA and water absorption studies were carried out on FEAM employing sweatband prototypes showing they would be suitable for use in the action of a hockey game. Sport headbands were next studied with the added feature that a head garment must be stretchable. This was found to be a challenge. Here, Spandex® containing, stretchable fabrics were first used to fabricate some prototype headband structures. A stretchable prototype headband was created by cutting slits into the width section of the double-side flocked fabric central core element of the assembled headband. While this was found to increase, albeit only slightly, the stretchability of the configuration, the slits caused uneven lumps and gross unevenness in the headband's span. This approach was also deemed unacceptable. Next, the concept of segmenting loosely held "pockets" containing FEAM IFA material along the length of the headband's span was tried. This arrangement succeeded in creating what is believed to be a suitably stretchable headband structure. This configuration has been called a Wrap-Around Padded Headband (WAPH) structure. The concept featured a double-thickness zone in the over-lap section of the headband that could serve as extra head protection for the forehead and frontal head areas. The WAPH structure also feature a diagonally sewn separation seam between the FEAM containing "pockets" of the headband. This geometrical arrangement well satisfied the stretchability requirement of the subject sport headband.

WAPH headband design are useful in creating other impact protecting body pad garments such as under-helmet comfort liners, wrist and ankle bands and elbow pads. Additionally, other impact body protection pad structures could be developed using the general (three material component) FEAM design parameters described below.

While impact protection is not the traditional feature of sport sweat and headbands, imparting an IFA feature into such headwear garments could be beneficial in the context of mitigating sport action generated head injuries. Head injuries incurred during sport, military, domestic (especially geriatric) activity can often be a most debilitating event for humankind.

Described below are IFA headband, sweatband and body impact protection pad structures that are usually under 12.5 mm (0.50") thick and being broadly flexible and worn on the body as specialized apparel. Examples of such apparel are (a) in-helmet forehead positioned hockey goalie helmet (and baseball catcher and industrial hard-hat) sweatbands. (b) headband garments (c) against the body pad or liner garments worn as under or outside the garment serving to shield an athlete from specific body-part impact injury (e. g. head, arms, wrists, elbows, shins, chest, hips, etc.). All these applications require thinner, light-weight, body conforming flexible IFA layers with as thin a cross-section as functionally possible. It will be shown that such configurations are readily created when FEAM core elements are sandwiched between two outer fabric layers forming in a "three-component" IFA pad FEAM employing structure.

IFA Testing

A Guided Weight Drop (GWD) test was employed in tests described below. Here a 5.0 Kg projectile steel weight projectile is gravity-dropped from a continuously adjustable set height (from 25 to 200 cm). The dropped projectile is fitted with an accelerometer to measure its strike velocity. The test sample is further mounted on a force table which registers the force-time tracing of the impact-action event. The "strike face" of the falling 5 Kg projectile has a 12.5 cm. diameter hemi-spherical shape. Since the gravity dropped projectile is fitted with an accelerometer, kinetic energy of this strike projectile is calculable; as for example, 49.0

Joules at a 100 cm drop height. This kinetic energy is calculated from the measured velocity and the projectile's mass. In this GWD test, Force Loss (FL %) and the impact-projectile's deceleration value "g" (g-value) are measured and reported as a measure of the specimen's overall IFA properties. FL % is determined from by comparing the peak strike force with and without the presence of a test sample mounted on the apparatus's force table. "g" is calculated by dividing the strike velocity by the event's Impact Duration Time (IDT).

Water Pick-up

To simulate sweat absorption properties, sample water immersion tests were carried out on representative sweat-band and headband pad configurations in order to provide an estimation of sweatband/headband material's efficacy in absorbing water/sweat. The test involved submerging the samples in room temperature water and periodically removing, weighing, and re-immersing them in the water as the immersion time proceeded. This timed weighing was processed by quickly removing the samples from the water and allowing them to drain off to the drip-stage before they were weighed. For the first 40 minutes of these test, the time sample's weighing time (out of immersion) was deducted from the continued flow of time; only the time the sample was submerged in water was counted as the immersion time. This replicate procedure was done as rapidly as possible so as not to drastically distort the time-line for the data; especially at the beginning of the experiment.

Materials

The FEAM nomenclature scheme used in this document was fully explained in a previous publication [2]. The flock fibers used in this study were obtained from Spectro Coatings, Inc., Leominster, MA. The flocked-upon "base" fabrics were all obtained from a local JoAnn fabrics retail store. Divider/separator fabrics were 100% polyester plain-weave (microsuede) "liner" fabrics obtained from JoAnn Fabrics. Two flock adhesives were used, FF 3822 (standard) and FF T100-795 (elastomeric adhesive); they were obtained from Key Polymer, Lawrence, MA. The VelTex® loop fabric used in these studies was obtained from Industrial Webbing Company, Boynton Beach, FL. VelTex® is a product manufactured by the Velcro® Corporation. It is a "loop" fabric (laminate) that readily accepts Velcro® hook strips. Additionally, other types of Velcro® hook adaptable fabrics were obtained from Gehring-Tricot Corp., Hauppauge, NY were used; these are designated as types WW1733 and WW 1373. The WW1373 fabric contains Spandex® which renders the fabric stretchable.

Sample Preparation

Flocking was done using a laboratory DC up-flocker (Maag-Flock HEK 200-80). After flocking, the samples were allowed to stand for at least 16 hours at room temperature before they were post-cured in an oven for 1 hour at 120 degrees centigrade. All GWD test samples were about 10 cm×10 cm (4"×4") in size. In multiple FEAM layer configurations, all contiguous flocked surfaces were separated from each other by a light-weight, 100% polyester (PET) plain (microsuede) weave separator/divider fabric. These assembled test panel layers were finally covered with a Velcro® hook adaptable fabric (VelTex® or Gehring-Tricot) and perimeter sewn. All test measurements were an average of at least three (3) "strike" determinations on the same sample.

Evaluation of FEAM Three Material Component Structures

IFA Features of Three-Component FEAM Configurations

The "generic" three-component FEAM configuration that served as the basis for this sport-pad design development study is shown in FIG. 1. This three-material IFA pad configuration is composed of: Velcro® hook adaptable fabric//selected double-side flocked layer "core"//Velcro® hook adaptable fabric; with the central double-side flocked layer "core" enveloped in a thin fabric divider/separator fabric. This divider fabric is needed to prevent the flock fiber ends from embedding themselves, during deformational impact, into the soft-back-textured VelTex® or Gehring-Tricot (outer cover fabric) backside. Previous experiments [1] have shown that without this divider/separator fabric, the FL % properties of tested pad samples were found to be 10% to 20% lower compared to when divider fabrics were present. Divider fabrics are always needed to preserve the reversible "spring action" of the dynamically compressed FEAM material.

FIG. 1 shows a Functional Three-Component IFA Body-Protection Pad Structure including a base fabric for the double-side flocked fabric element ("core") of three-layer FEAM Structure, separator fabric and Velcro® Hook adaptable outer fabric (e.g., VelTex® or WW1733 or 1377 fabric).

Segmented FEAM-Pad Headband

Figures 2A, 2B, 2C:
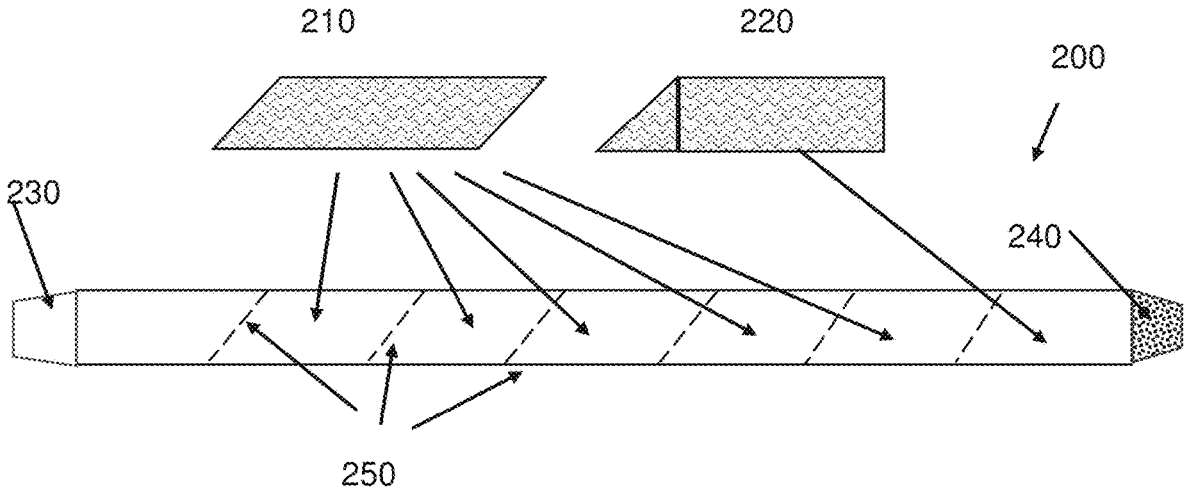
FIG. 2A is a schematic diagram of an impact force absorbing panel Mid-Segments in accordance with one example embodiment disclosed herein.
FIG. 2B is a schematic diagram of a flock fiber of the impact force absorbing panel End-Segment in accordance with one example embodiment disclosed herein.
FIG. 2C is a schematic diagram of the impact force absorbing headband including segments of FIGS. 2A and 2B enclosed in a divider fabric having 45 degree, diagonally (sewn) separator seams in accordance with one example embodiment disclosed herein.

Stretchability of a FEAM employing headband is provided by breaking up the headband's continuous "band" of FEAM "core" into segments. The FEAM elements are loosely enclosed in a linear series of "pockets" made up of stretchable WW1373 type cover fabric, stretchability occurs at the free-standing walls of each pocket and at the junction or dividing lines between each contiguous pocket. In essence, the headband configuration would take the form of enclosing a linear array of individually functioning FEAM IFA pads. Since the FEAM pads are not attached to the stretchable WW1373 cover fabric, the cover fabric could easily stretch as a unitary fabric. Its stretch would be hindered by only the sewn dividing zones between the freely encapsulated FEAM segments. These zones serve to hold the FEAM segments in place during the stretching. Note too that the microsuede separator fabric that envelops the flocked fabric does not have to be stretchable. The FEAM modules are loose and free to move, slide or whatever in its enclosed pocket. Each FEAM segment will function as an individually functioning IFA component. Two forms of headband are provided: (1) a "fixed size and (2) a Warp-Around one-size-fits-all design. A sketch of a stretchable, segmented (pocketed) FEAM element headband is shown in FIGS. 2A-2C.

Figure 3:
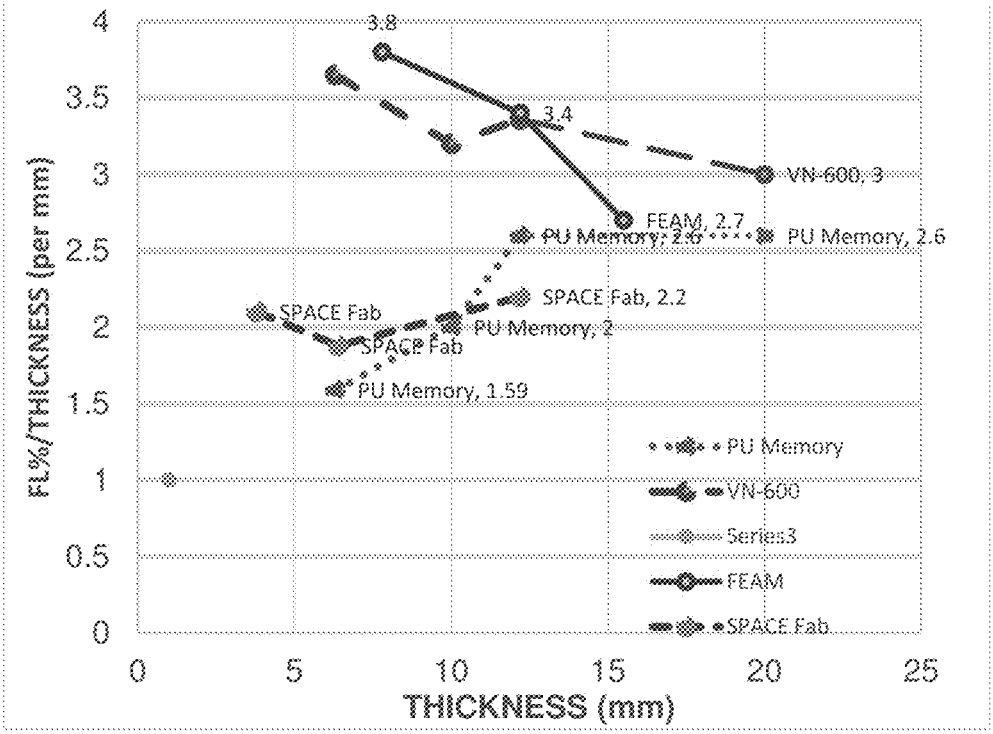
FIG. 3 is GRAPH OF FL %/Thickness Ratios for Representative IFA Materials.

GWD data for various three-component test samples employing core layers prepared using fiber deniers from 20 to 136 denier and at lengths of 2 to 4 mm are presented in Table 1. These GWD data were obtained at 25, 50 and 100 cm drop heights. FIG. 3 is a graph of FL %/Thickness Ratios for Representative IFA Materials.

TABLE 1

IFA of "Three-Component" FEAM Configurations (a)(b)(c)

| Lab ID | Description(d) | Thickness (mm) | Areal Density ($g/m^2$) | "g" 25 cm | FL % 25 cm | "g" 50 cm | FL % 50 cm | "g" 100 cm | FL % 100 cm |
|---|---|---|---|---|---|---|---|---|---|
| 022-A | VT/FX202-2D/VT | 6.8 | 1676 | 6.4 ± 0.5 | 73.8 ± 2 | 28.6 ± 2 | 49.8 ± 2 | 92.8 ± 2 | 18.2 ± 2 |
| 005-B | VT/FX452-2D/VT | 6.8 | 1573 | 5.0 ± 0.5 | 80.9 ± 2 | 26.6 ± 1 | 55.9 ± 3 | 90.8 ± 1 | 22.1 ± 1 |
| 005-A | VT/FX452-3D/VT | 10.6 | 1881 | 5.8 ± 0.5 | 76.9 ± 1 | 22.9 ± 1 | 62.6 ± 2 | 86.1 ± 1 | 27.8 ± 1 |
| 015-A | VT/FX602-2D/VT | 7.4 | 2198 | 6.4 ± 0.5 | 72.8 ± 1 | 33.9 ± 1 | 45.0 ± 1 | 89.9 ± 1 | 23.8 ± 1 |
| 022-E | VT/FX601-2D/VT [d] | 6.3 | 1952 | 7.6 ± 0.5 | 66.0 ± 2 | 32.6 ± 2 | 41.5 ± 2 | 96.2 ± 2 | 15.8 ± 2 |
| 022-D | VT/FX601-3D/VT [d] | 9.2 | 2072 | 5.6 ± 0.5 | 76.8 ± 2 | 24.7 ± 1 | 58.5 ± 2 | 90.0 ± 2 | 23.3 ± 2 |
| 150-A | VT/FX602-4D/VT | 13.8 | 2214 | 5.6 ± 0.5 | 77.7 ± 1 | 24.3 ± 2 | 61.2 ± 2 | 82.7 ± 2 | 33.6 ± 2 |
| 016-A | VT/FX1002-2D/VT | 7.8 | 2182 | 7.0 ± 0.5 | 69.1 ± 1 | 31.3 ± 2 | 44.2 ± 2 | 86.0 ± 2 | 30.0 ± 2 |
| 016-B | VT/FX1002-3D/VT | 12.2 | 2562 | 5.7 ± 0.5 | 75.5 ± 2 | 23.3 ± 2 | 61.5 ± 2 | 76.6 ± 2 | 41.2 ± 2 |
| 034-B | VT/FX1002-4D/VT | 15.5 | 2104 | 4.6 ± 0.5 | 82.6 ± 2 | 20.6 ± 1 | 67.4 ± 2 | 73.9 ± 1 | 42.1 ± 2 |
| 040-C | VT//FX1362-1D//VT | 5.1 | 1819 | 19. ± 1.0 | 55.4 ± 2 | 53.6 ± 1 | 33.4 ± 2 | 102.7 ± 2 | 16.7 ± 2 |
| 040-A | VT//FX1362-2D//VT | 7.8 | 2025 | 19.4 ± 1 | 56.1 ± 3 | 49.1 ± 1 | 41.9 ± 2 | 98.0 ± 1 | 23.7 ± 0 |
| 041-B | WW1733//FX1362-1D//WW1733 (e) | 4.2 | 1410 | 26.3 ± 1 | 37.4 ± 2 | 59.9 ± 1 | 22.5 ± 2 | 107.3 ± 0 | 10.2 ± 0 |
| 041-A | WW1733//FX1362-2D//WW1733 (e) | 6.2 | 1714 | 24.6 ± 0 | 42.5 ± 1 | 54.8 ± 0 | 32.7 ± 1 | 103.2 ± 2 | 17.9 ± 2 |

(a) All test samples are 10 cm × 10 cm (4" × 4") and data are averages of three replicate determinations on the same test panel.
(b) The 25 cm, 50 cm and 100 cm values refer to drop height.
(c) All flocked "cores" of these samples are wrapped with Micro-Suede fabric as divider fabric before
[d] VelTex ® (abbreviated as VT) covered and perimeter sewn.
(e) FEAM test panels prepared using polyester flock fibers.

As expected, "g" decreases (favorable) as the FL % increases (favorable) with the decrease in projectile drop height. These three drop heights represent kinetic energy impacts of 12.2 (25 cm), 24.5 (50 cm) and 49.0 (100 cm) Joules. Table 1 data also show that at the 100 cm drop height, the structure's IFA properties generally improve as the denier of the FEAM flock fiber "core" component increases; up to and including the 100 denier panels. For some reason, a significant drop-off in IFA properties was observed at the 136-denier level. This denier effect trend was not clearly followed with the 25 cm and 50 cm drop height data. Continuing, an overall positive trend in IFA performance was found as the length of the flock fiber increased. However, this trend is accompanied by an expected increase in sample thickness. Importantly, however, this trend was followed for all the flock fiber FEAM panels studied. These Table 1 data have also uncovered two additional design facets for FEAM structures: (a) nylon flock fiber fabricated FEAM panels result in a slightly higher IFA performing panel than the polyester flock fiber containing panel (compare the 015-A data with the 022-A), and (b) VelTex®-Velcro® hook adaptable outer fabrics seems to result in slightly higher IFA performance compared to the IFA panels prepared using the Ghering-Tricot WW1733 outer fabric (compare test panel data for 040-C and 040-A with 041-B and 041-A). Note, however, that WW1733® covered test panels are slightly thinner compared to the VelTex® faced panels. Overall, then, the GWD data in Table 1 should be very useful for designing three-component FEAM sweatband/headband type body IFA pad prototypes.

FEAM IFA Properties Relative to Thickness

When considering sweatband, headband and body pad design parameters, it is recognized that most of these sport accessories will be worn either (a) under-the-helmet or (b) under a worn garment. Under-the-helmet sweatbands and headbands must be as thin as possible and still serve their function. From this, it was decided that studying an IFA material's FL % to thickness ratio would be a design parameter of importance. Therefore, the FL % data collected in Table 1 were so-analyzed with FL %/thickness (mm) ratio data presented in Table 2. These Table 2 FL %/thickness ratio data show that for the most part, the shorter length flock fiber containing FEAM configurations exhibit higher FL %/thickness ratios. Also, the FL %/thickness ratio increases as the denier of the flock fiber increases. This translates into the very important design trend that overall, the thinner, FEAM core elements that contain 2 mm long and 100 denier flock fiber have the highest IFA properties per thickness. This suggests that while FEAM pad structures with longer flock fibers exhibit better overall FL % properties, the most efficient FL % properties of FEAM structures per thickness are obtained when shorter flock fibers (in this case 2 mm long) are used.

TABLE 2

FL % Per Thickness for Various "Three-Component" FEAM Configurations (refer to Table 1) (a)(b)(c)

| Lab ID | Description (d) | Thickness (mm) | Areal Density ($g/m^2$) | FL %/mm 25 cm | FL %/mm 50 cm | FL %/mm 100 cm |
|---|---|---|---|---|---|---|
| 022-A | VT/FX202-2D/VT | 6.8 | 1676 | 10.8 | 7.3 | 2.7 |
| 005-B | VT/FX452-2D/VT | 6.8 | 1573 | 11.9 | 8.2 | 3.2 |
| 005-A | VT/FX452-3D/VT | 10.6 | 1881 | 7.2 | 5.9 | 2.6 |
| 015-A | VT/FX602-2D/VT | 7.4 | 2198 | 9.8 | 6.1 | 3.2 |
| 022-E | VT/FX601-2D/VT | 6.3 | 1952 | 10.5 | 5.2 | 2.5 |

TABLE 2-continued

FL % Per Thickness for Various "Three-Component" FEAM Configurations (refer to Table 1) (a)(b)(c)

| Lab ID | Description (d) | Thickness (mm) | Areal Density ($g/m^2$) | FL %/mm 25 cm | FL %/mm 50 cm | FL %/mm 100 cm |
|---|---|---|---|---|---|---|
| 022-D | VT/FX601-3D/VT | 9.2 | 2072 | 8.3 | 6.4 | 2.5 |
| 150-A | VT/FX602-4D/VT | 13.8 | 2214 | 5.6 | 4.4 | 2.4 |
| 016-A | VT/FX1002-2D/VT | 7.8 | 2182 | 8.8 | 5.7 | 3.8 |
| 016-B | VT/FX1002-3D/VT | 12.2 | 2562 | 6.2 | 5.0 | 3.4 |
| 034-B | VT/FX1002-4D/VT | 15.5 | 2104 | 5.3 | 4.3 | 2.7 |
| 040-C | VT//FX1362-1D//VT | 5.1 | 1819 | 10.9 | 6.5 | 3.3 |
| 040-A | VT//FX1362-2D//VT | 7.8 | 2025 | 7.2 | 5.4 | 3.0 |
| 041-B | WW1733//FX1362-1D//WW1733 (e) | 4.2 | 1410 | 8.9 | 5.4 | 2.4 |
| 041-A | WW1733//FX1362-2D//WW1733 (e) | 6.2 | 1714 | 6.8 | 5.3 | 2.9 |

(a) Test values are an average of at least three (3) replicate determinations.

(b) This test samples are all 10 cm × 10 cm (4" × 4")

(c) The 25 cm, 50 cm and 100 cm values refer to drop height.

(d) All flocked "cores" of these samples are wrapped with Micro-Suede fabric as divider fabric before VelTex ® (abbreviated as VT) covered and perimeter sewn.

FL %/Thickness Ratios for Representative IFA Materials: As this document concerns the IFA of thinner cross-section impact absorbing materials, it is important to establish the FL %/thickness ratio properties of FEAM relative to other impact materials. Correspondingly, FIG. 3 compares the FL %/thickness behavior of vinyl nitrile foam, polyurethane (memory) foam, spacer fabric and a selected FEAM configuration. FIG. 3 shows that the FEAM structure performed among the best in FL %/thickness ratio properties. The FEAM panel had FL %/thickness ratio properties equal to or better than VN-600 (vinyl nitrile foam), a widely used helmet pad foam material. However, compared to other IFA materials, FEAM has much better breathability, textile based sweat absorbing capability, ply-ability and against-the-body conformity compared to vinyl nitrile and all other foam materials. It can be concluded then that the FEAM concept should be the IFA material of choice for all against-the-head and body protection impact pad applications.

FEAM IFA Properties Relative to Areal Density: Further data analysis was carried out to evaluate the trend in FL % with Areal Density (AD). Here a table was prepared again using the data from Table 1. The resulting Table 3 data show that the longer the flock fiber in the FEAM three-component configuration, the higher is the FL %/AD ratio. This is the opposite trend to what was found in the FL %/thickness ratio study. These results thus conclude that a property "trade-off" situation is encountered when designing thin cross-section FEAM employing IFA pad configurations. For FEAM core sweatband and headband garments, it is found that while longer flock fiber gives lower FL %/thickness ratios, longer flock fiber results in higher FL %/AD ratios. A property trade-off situation arises; very common event in engineering design activities. Therefore, with these two design parameters defined, the goal of this study will now focus on finding a FEAM configuration that will result in the best performing FEAM employing body pad.

TABLE 3

FL % Per Areal Density (AD) for Various "Three-Component" FEAM Configurations (refer to Table 1) (a)(b)(c)

| Lab ID | Description (d) | Thickness (mm) | Areal Density ($g/m^2$) | FL %/AD 25 cm | FL %/AD 50 cm | FL %/AD 100 cm |
|---|---|---|---|---|---|---|
| 022-A | VT/FX202-2D/VT | 6.8 | 1676 | .0440 | .0279 | .0109 |
| 005-B | VT/FX452-2D/VT | 6.8 | 1573 | .0514 | .0355 | .0140 |
| 005-A | VT/FX452-3D/VT | 10.6 | 1881 | .0409 | .0333 | .0148 |
| 015-A | VT/FX602-2D/VT | 7.4 | 2198 | .0331 | .0205 | .0108 |
| 022-E | VT/FX601-2D/VT | 6.3 | 1952 | .0338 | .0213 | .0081 |
| 022-D | VT/FX601-3D/VT | 9.2 | 2072 | .0371 | .0282 | .0112 |
| 150-A | VT/FX602-4D/VT | 13.8 | 2214 | .0351 | .0276 | .0152 |
| 016-A | VT/FX1002-2D/VT | 7.8 | 2182 | .0317 | .0203 | .0137 |
| 016-B | VT/FX1002-3D/VT | 12.2 | 2562 | .0295 | .0240 | .0161 |
| 034-B | VT/FX1002-4D/VT | 15.5 | 2104 | .0393 | .0320 | .0200 |
| 040-C | VT//FX1362-1D//VT | 5.1 | 1819 | .0305 | .0184 | .0092 |
| 040-A | VT//FX1362-2D//VT | 7.8 | 2025 | .0277 | .0207 | .0117 |
| 041-B | WW1733//FX1362-1D//WW1733 (e) | 4.2 | 1410 | .0265 | .0160 | .0072 |
| 041-A | WW1733//FX1362-2D//WW1733 (e) | 6.2 | 1714 | .0248 | .0191 | .0104 |

(a) All test values are an average of at least three (3) replicate determinations.

(b) This test samples are all 10 cm × 10 cm (4" × 4")

(c) The 25 cm, 50 cm and 100 cm values refer to drop height.

(d) All flocked "cores" of these samples are wrapped with Micro-Suede fabric as divider fabric before VelTex ® (abbreviated as VT) covered and perimeter sewn.

Hockey Goalie Helmet Sweatbands

Figure 4:
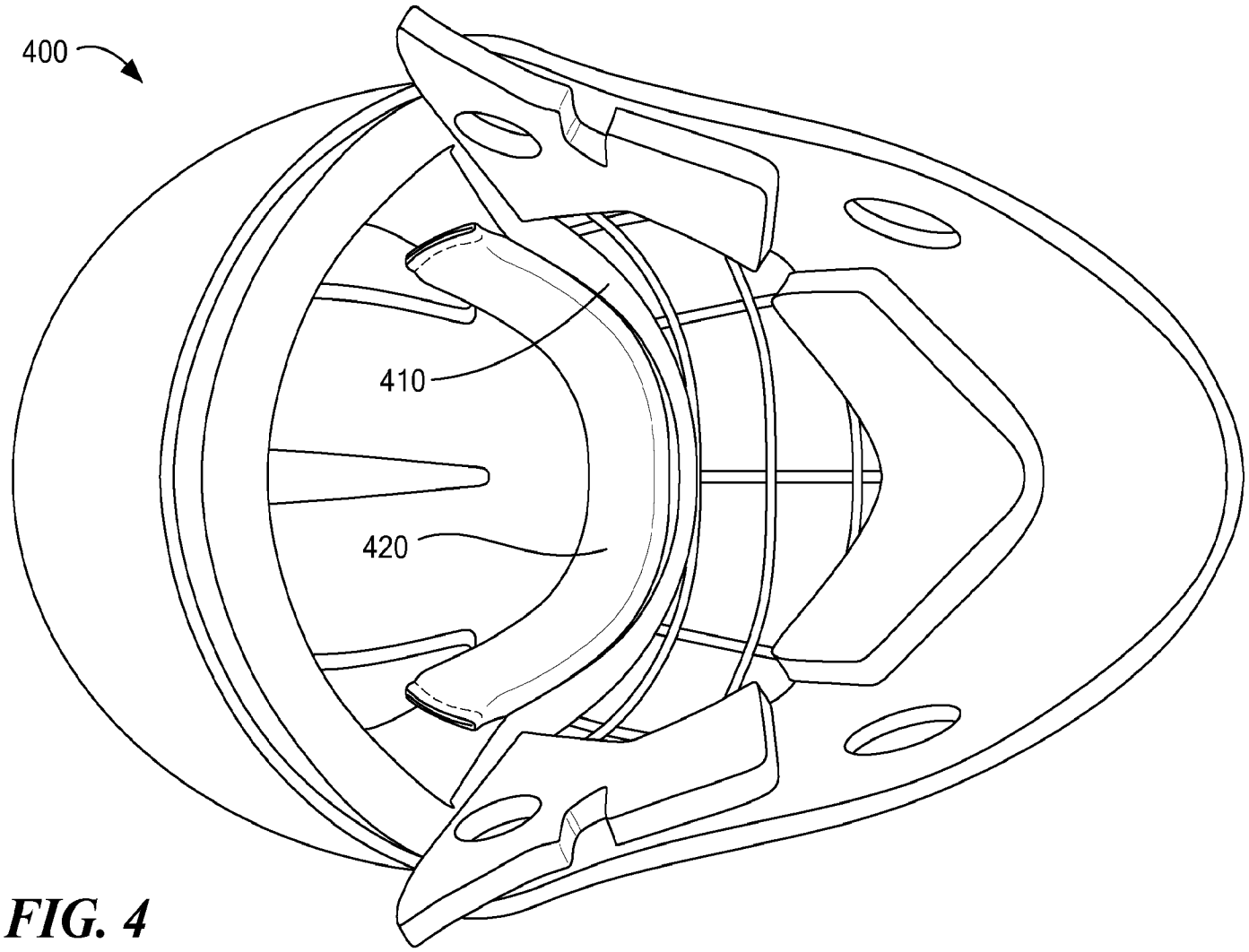
FIG. 4 is a diagram of VelTex® Outside Covered Sweatband Mounted in Forehead Section of Hockey Goalie Helmet in accordance with one example embodiment disclosed herein.
Figure 5A:
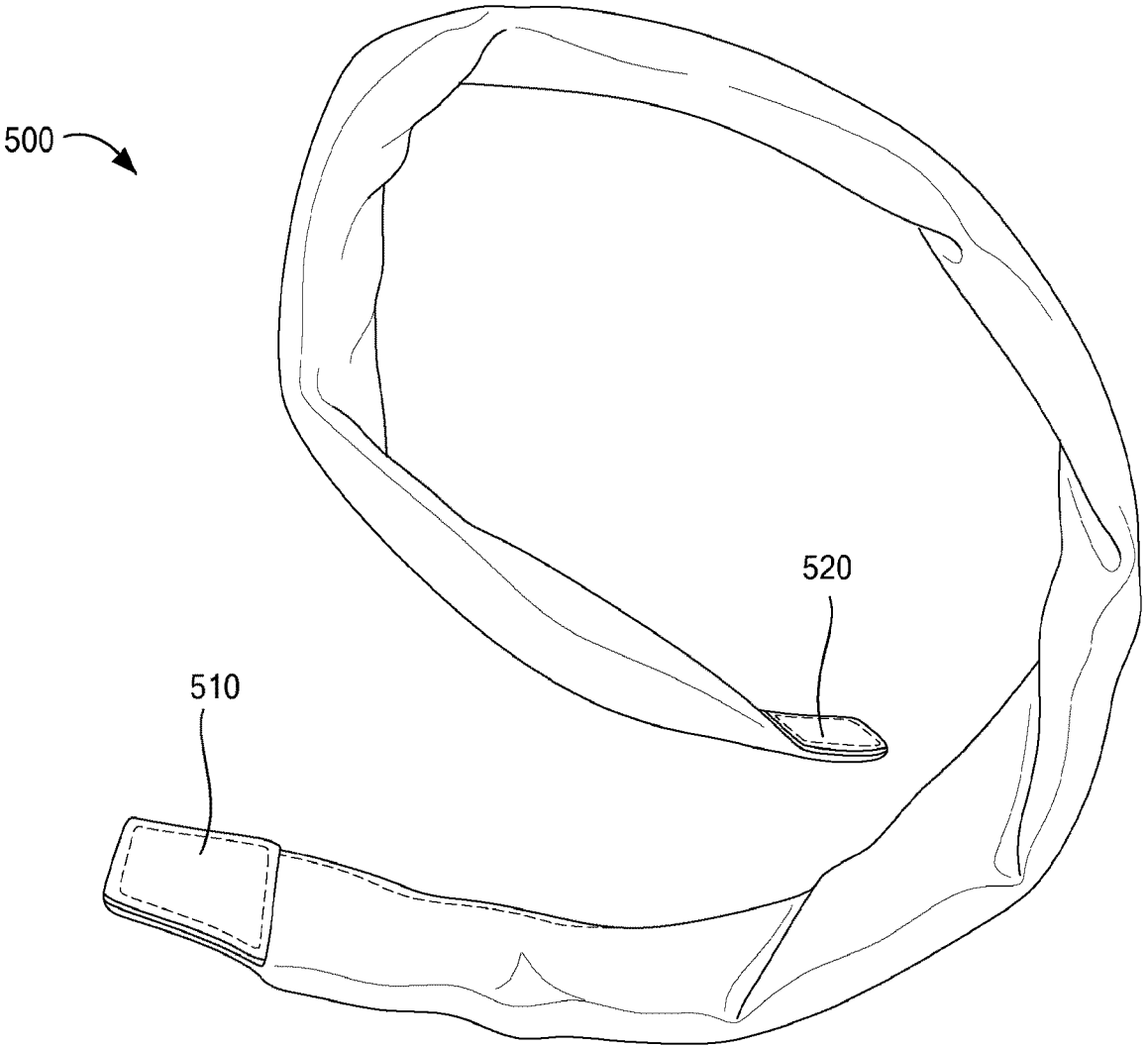
FIG. 5A is a diagram of showing starting the closure of the WAPH headband of FIG. 4.
Figure 5B:
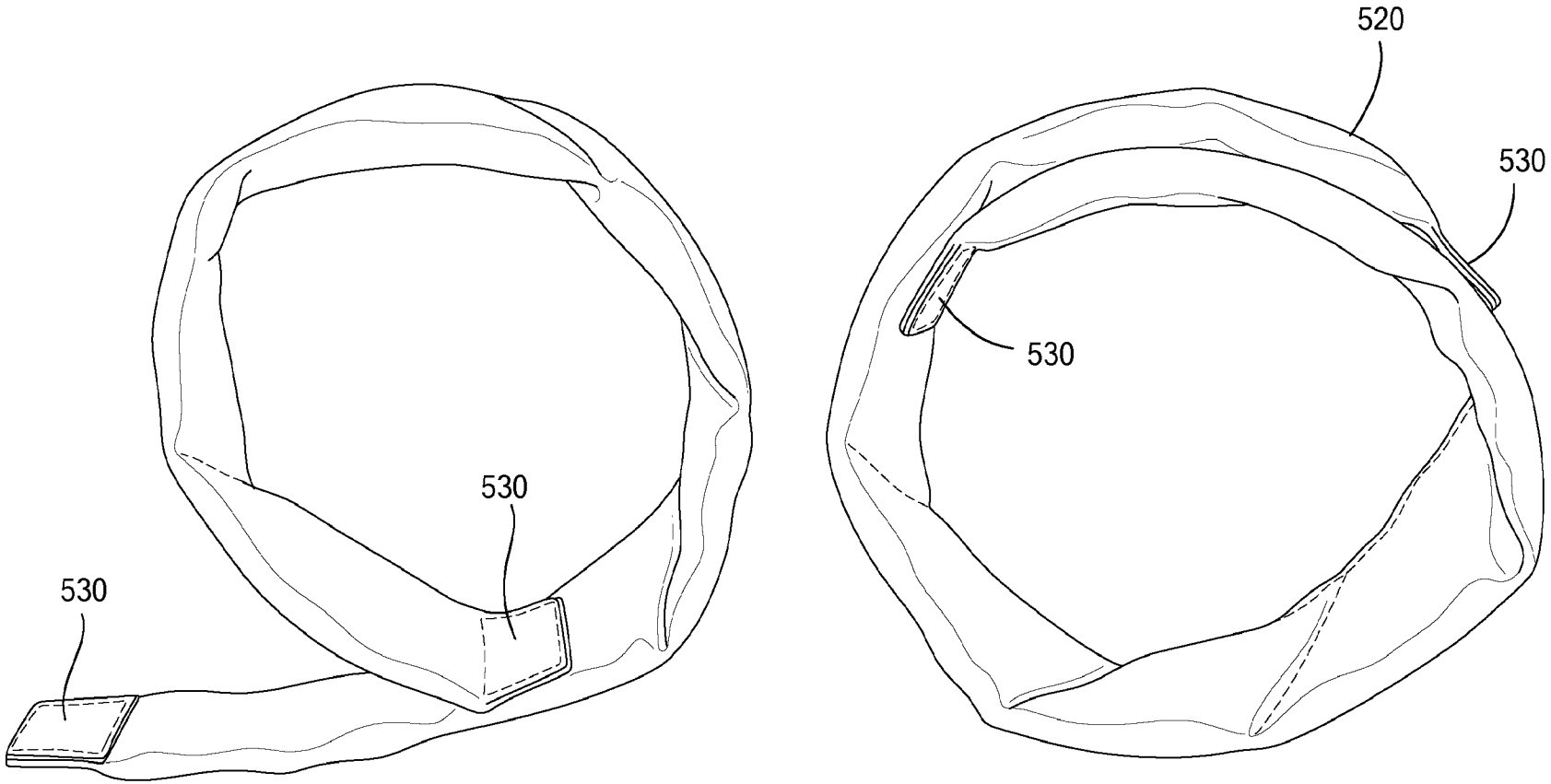
FIG. 5B is a diagram of showing the completing the closure of the WAPH headband of FIG. 4.
Figure 6A:
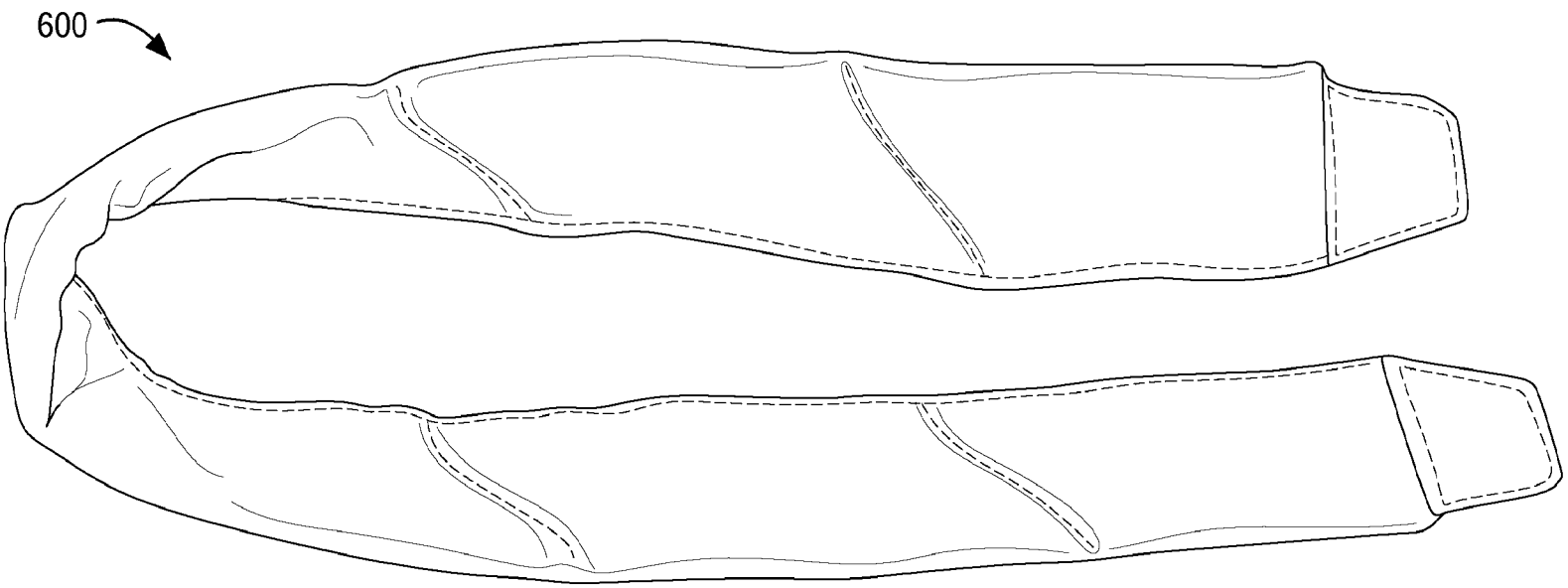
FIGS. 6A-6C are diagrams showing the features of WAPH headband of FIG. 4.
Figure 6C:
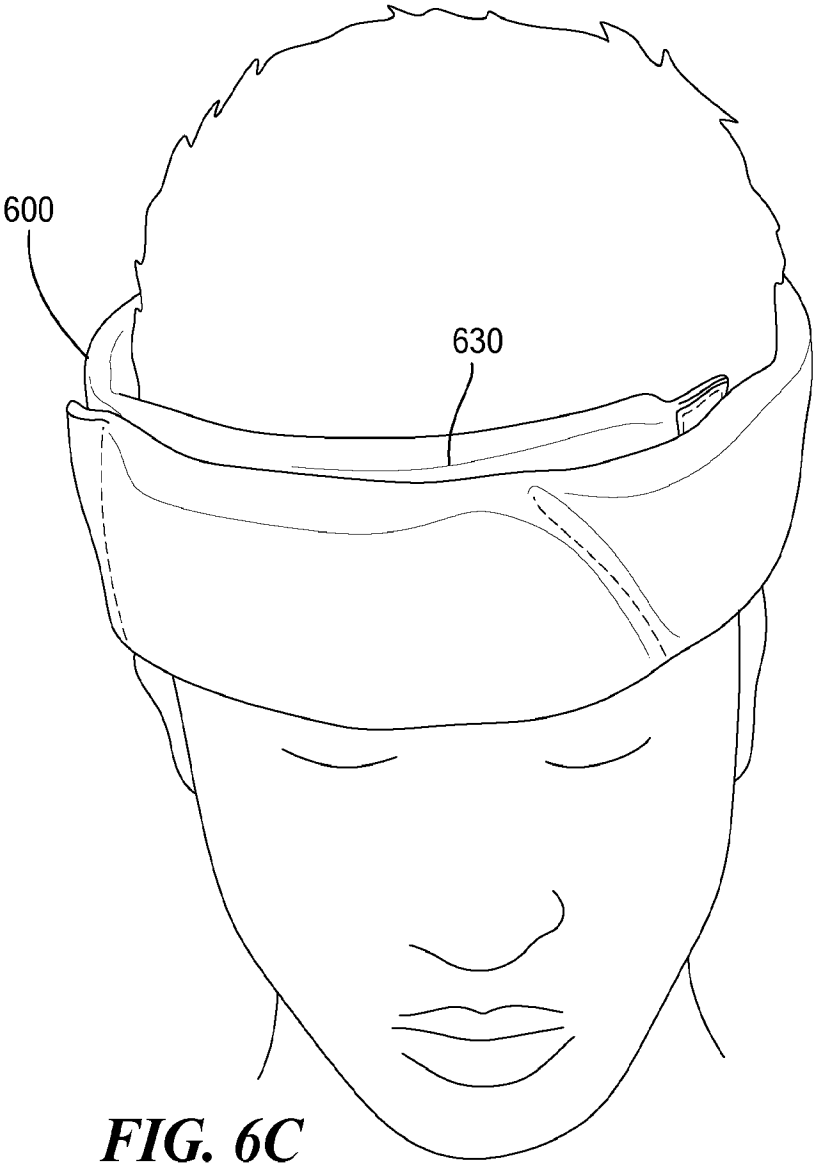
Figure 6B:
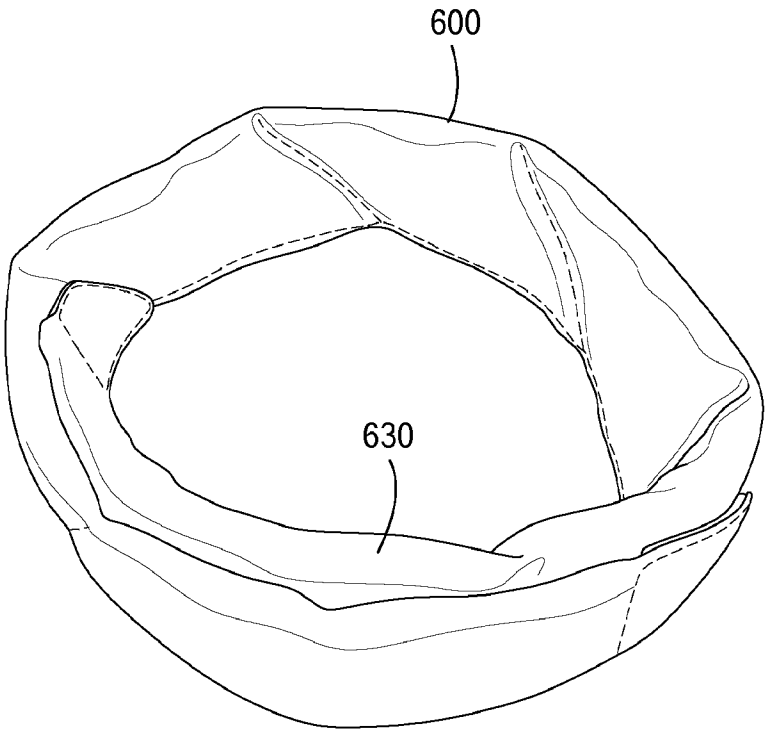

The first FEAM employing engineering design task was to create a hockey goalie helmet sweatband. An installed sweatband pad structure is pictured in FIG. 4. A sweatband is approximately 3.8 cm (1¾")×20.3 cm (8") in size and is Velcro® attached to the inside of a hockey goalie helmet (baseball catcher's mask or hard hat) as shown. The primary purpose of the sweatband is to manage the heat and sweat generated by the hockey athlete during sport action. While the sweatband's function is to absorb head-sweat, the fact that FEAM is employed in its construction should simultaneously provide the wearing athlete with some important IFA head impact protection. A bonus feature of FEAM employing sweatbands.

Water Absorption Properties of Sweatband Configurations

Before a final FEAM employing sweatband-design is confirmed, it was decided to evaluate the water absorption properties of representative sweatbands. A water immersion test was devised to provide some information on a sweatband's propensity for absorbing water (sweat). For this, several FEAM employing sweatbands were fabricated, Also, for comparison, several commercially available hockey goalie sweatbands were obtained as a means of comparison. In this context, the FEAM employing sweatbands could be compared with already existing sweatband configurations. The test involved fully submerging the sweatband in room temperature water and following the grams of water pick-up (removing, weighing and re-immersing) during the sample's immersion time. Proceeding, the first notable observation was that for all the sweatbands tested, most of the water (e.g., 90% to 95%) of the water pick-up occurred during the first 20 to 40 minutes of immersion. After this time, water pick-up more of less leveled off. However, all tests were carried out for seven hours or up to eighteen immersion hours to establish a reliable value for the sweatband's equilibrium water pick-up volume. For the data analysis, the Table 4 data presents two parameters of interest: (a) total grams of water pick-up by the sweatband within the first two minutes of immersion, and (b) the final equilibrium-volume of water pick-up (grams/cm$^3$) based on the physical volume of the sweatband (length×width×thickness). Therefore, this equilibrium number is normalized to the geometry of each sweatband.

Table 4 data indicate that FEAM employing sweatbands, are most rapid in water pick-up. The closest commercial sweatband to the FEAM sweatbands was the A & R Sports "Terrycloth" replacement sweatband. Continuing, the VelTex® covered FEAM employing sweatbands and the A & R Sports, "Terrycloth" sweatbands performed the best in overall water pick-up per volume at equilibrium. Therefore, these water immersion tests show that FEAM employing sweatband configurations should be as good as if not better in sweat absorption properties of many commercially available sweatbands. Note, however, the FEAM employing sweatbands have the IFA feature. This is not available in any presently available commercial sweatband.

Final FEAM Employing Sweatband Body-Pad Configuration

Referring to the accumulation of sweatband data, for an optimum performing hockey goalie helmet sweatband, it is proposed that laminar structures composed of a double-side flocked FEAM core element prepared using 60 to 100 denier, 3 mm long nylon flock fiber should be used. This double-side flocked "core" material must be enveloped in a thin plain weave divider/separator fabric (like a plain weave, light weight 100% PET microsuede fabric) before it is finally cover-wrapped with a Velcro® hook adaptable outer, cover fabric (VelTex® or WW1733). It is found that using VelTex® for the outer cover of these pads showed better IFA properties compared to pads using the WW1733 fabric. However, this IFA improvement is accompanied by a slight thickness increase.

TABLE 4

Water Pick-Up Behavior of Various Sweatbands

| Sample | Thickness (mm) | Sample Volume (cm$^3$) | Grams Water Pick-Up (at 2 minutes immersion) | Equilibrium Water Pick-Up Volume (g/cm$^3$) (e) |
|---|---|---|---|---|
| FEAM VT cover (052-C) (a) | 8.5 ± 0.2 | 82.3 | 39.7 | 0.601 ± 0.016 |
| FEAM VT cover (128-A) (b) | 7.4 ± 0.2 | 72.5 | 58.4 | 0.789 ± 0.026 |
| FEAM WW1758 cover (128-B) (c) | 7.3 ± 0.2 | 77.7 | 37.9 | 0.539 ± 0.027 |
| Reebok-CCM (d) | 4.9 ± 0.4 | 34.4 | 12.2 | 0.551 ± 0.032 |
| Bauer(d) | 6.5 ± 0.3 | 73.1 | 25.7 | 0.447 ± 0.038 |
| A&R Terrycloth (d) | 5.4 ± 0.1 | 57.5 | 35.6 | 0.649 ± 0.009 |

(a) VT//FX1362-2S:FX1362-2S//VT
(b) VT//FX202-2D//VT
(c) WW1758//FX202-2D//WW1758
(d) CCM, Bauer and A & R Sports are "replacement" sweatbands.
(e) Water Pick-Up rate generally leveled off at about the 40-minute immersion time for all sweatbands. Equilibrium Volume Water pickup was the average of the water pick-up per volume of the sweatband for the values taken (at random times) to at least 7 hours after initial immersion.

Stretchable Material Component Experimentation

Unlike hockey goalie helmet sweatbands, headband "strap" structures must be linearly stretchable. Headbands must be able to function as elastically-fitted, wrap-around-the-head, band-like head garments. At first, the most direct approach to developing a stretchable headband would be to fabricate it using stretchable material components. Fortunately, stretchable (Spandex® containing) fabrics are readily available for these FIG. 1-like constructions. Stretchable outer fabrics are also available with the availability of (Spandex® containing) Gehring-Tricot WW1373 type fabric; it is stretchable as well as Velcro® loop attachment capability. Additionally, Spandex® containing fabrics can also be used flocked surface divider/spacer fabrics in these constructions. The question remaining is—Can one develop a suitably stretchable double-side flocked fabric FEAM core? Commensurate with this a double-side flocked FEAM core, a panel of 3 mm long, 100 denier nylon flock fiber was prepared using a stretchable Spandex® containing base fabric. Here, an elastomeric flock adhesive was used [available from Key Polymer (T100-795)]. As these prototype headbands were being assembled, it was noticed that the double-side flocked Spandex® FEAM core element, did not have much stretchability. There was some stretch but it was a "hard" stretch—too hard a stretch for headband applicability. The FEAM "core" material did not match the stretchability—ease of the WW1373 outer cover fabric or the Spandex® divider/separator fabric. Also, these all Spandex® layer FEAM pad configurations were somewhat heavy; Spandex® containing fabrics are inherently heavy.

Prototypes of this WAPH design were fabricated having five, six and seven segments. Here it was found that the seven-segment design was the most stretchable and conformed to the head shape better than the headbands that contained fewer segments. It was therefore concluded that the seven segment WAPH-7 headband be the most promising design. To this end, FIGS. 5A-6C present photographs of a fabricated WAPH-7 garment showing the sequential head application steps and the unique features of this wrap-around headband design. As shown, this WAPH headband is unique in that for a sport headband, it offers the feature of double FEAM thickness padded IFA protection the area of headband overlap; extra frontal forehead protection is achieved. This should be advantageous for a sport headband. The other unique feature of WAPH is the diagonal FEAM segment separations. This diagonal separation assures that around the head's perimeter, some FEAM protection will always be functioning when the headband is stretched. On the contrary, if the segment separation were "square," a straight gap would occur when the headband is stretch-worn by the athlete. Now for a final WAPH design, the FEAM configuration developed for the sweatband configuration would be applicable. Namely, FEAM fabricated using a 60 to 100 denier, 3 mm long nylon, double-side flocked fabric core, wrapped in microsuede fabric on overall covered (specific to the WAPH design) with the Gehring-Tricot WW1373 outer cover will be the material configuration of choice. While a seven segment WAPH was demonstrated here, in a final application, there would be no problems fabricating WAPHs with more or fewer segments than seven to better fit the final application.

FEAM Employing IFA Body-Pad Design Considerations

Body pads are a special category of sport garment. Body pads are worn, by athletes, to protect parts of the body prone to physical impact/injury. Sometimes they can also be used to protect, cushion or shield an athlete's existing injuries from being further aggravated. Such would be an on-site, medically installed protection pad. Body pads may be worn by athletes whose position they play is subject to multiple body impacts. For example, baseball catchers might wear an IFA areal pad behind their existing chest protector to further cushion any against-the-body transmitted, fast-ball or foul-tip impacts they may encounter. Other athlete applications could relate to wearing arm, wrist and/or leg (shin) wraps to help mitigate the pain caused by a stray fast-ball's impacting the arm or shin of a baseball player during batting. Body pads could also be worn by hockey players to lessen the impact pain they endure when being struck in the wrist, shin, forearm or ankle by rapidly moving hockey pucks. In the field of ice hockey, hockey skates are a frequent target of foot injury from puck hits. It is conceivable that FEAM could be applied to this field of ice hockey. There could be many other sport applications for FEAM employing body pads An experimental IFA property study has been carried out on simple, three material component FEAM structures. A most important finding was uncovered in that FEAM materials performed as one of the better IFA materials for the creation of thin cross-section IFA pads. Supplementing this finding, it was found that for FEAM structures, FL %/thickness ratios increase with a decrease in FEAM panel thickness. In all FEAM configurations, panel thickness is strongly controlled by the length of the flock fiber (say 2 to 4 mm) used in fabricating the FEAM structure. Continuing, it is demonstrated that the IFA properties of FEAM structures improve as the length of the component flock fibers increase. This trend is accompanied by an increase in IFA/Areal Density ratio. As seen, then, these data trends oppose each other. It is therefore concluded that when designing IFA body pad structures, a property trade-off situation is encountered where the length of the FEAM flock fiber is the key. One requires that for in designing optimum IFA body pad structures it is desirable to have the highest IFA/thickness ratio at the lowest IFA/areal density (weight) ratio.

With the above as background, design parameters for two FEAM employing body-pad structures have been delineated; (a) Hockey Goalie (baseball catcher or hard hat) Helmet Sweatbands and (b) Wrap-Around Padded Headbands (WAPHs). In both instances, the optimum FEAM configuration is proposed to be a fabrication of 60 to 100 denier, 3 mm long double-side flocked central flocked fabric as the FEAM central element. This central element is further enveloped in a microsuede divider fabric. This FEAM element is then finally covered (perimeter sewn) in a Velcro® Hook adaptable outer fabric; VelTex® or Gehring-Tricot WW 1733 or WW1373 (stretchable) fabric. In a peripheral study it was found that FEAM structures a as good if not better that some commercially available IFA pad structures (sweatbands) in absorbing water (simulates sweat absorption). These data support the prospect of FEAM excellent wearer comfort.

Wrap-Around padded Sport Helmet Liners (WAHL) is another potential application. IFA pad wrist, knee and elbow bands are other potential applications for FEAM technology. Experimental results conclude that FEAM-employing body pad type garments should be (a) suitably IFA effective, (b) breathable (c) sweat absorbing (d) thin and light-weight (e) flexible and (f) very wearer comfortable; an excellent starting material for creating IFA body pad garments. Variations to the WAPH concept includes designs for Extra-IFA Protection Headbands and Motorcycle Helmet Liner Applications.

Preferred Number of Segments

WAPH fabrications were prepared having different numbers of FEAM (pocketed) Segments. WAPH samples were sewn having five, six, seven and eight segments. Each of the completed configurations were of a total length of about 32 inches.

Single-Band Structure

Fabrication studies of WAPH configurations have been carried out having five (5) to eight (8) FEAM containing segments. Segments include End-segments and Mid-segments as shown in FIGS. 2A and 2B above. In each of these configurations, the FEAM core elements were 1¾" wide and four (4) inches long for the end segments. The Mid-Segments were of various (equal) length to accommodate the needed 29-inch total length segmented part of the WAPH. For the seven segment (preferred) configuration (as shown above) the Mid-Section lengths were 3½". To finalize the configurations, the ends of each WAPH were fitted with 1½" long Velcro® Hook strip/tab sections. The total lengths of these preferred WAPHs are 32".

Single Overhead Strap

Figure 7A:
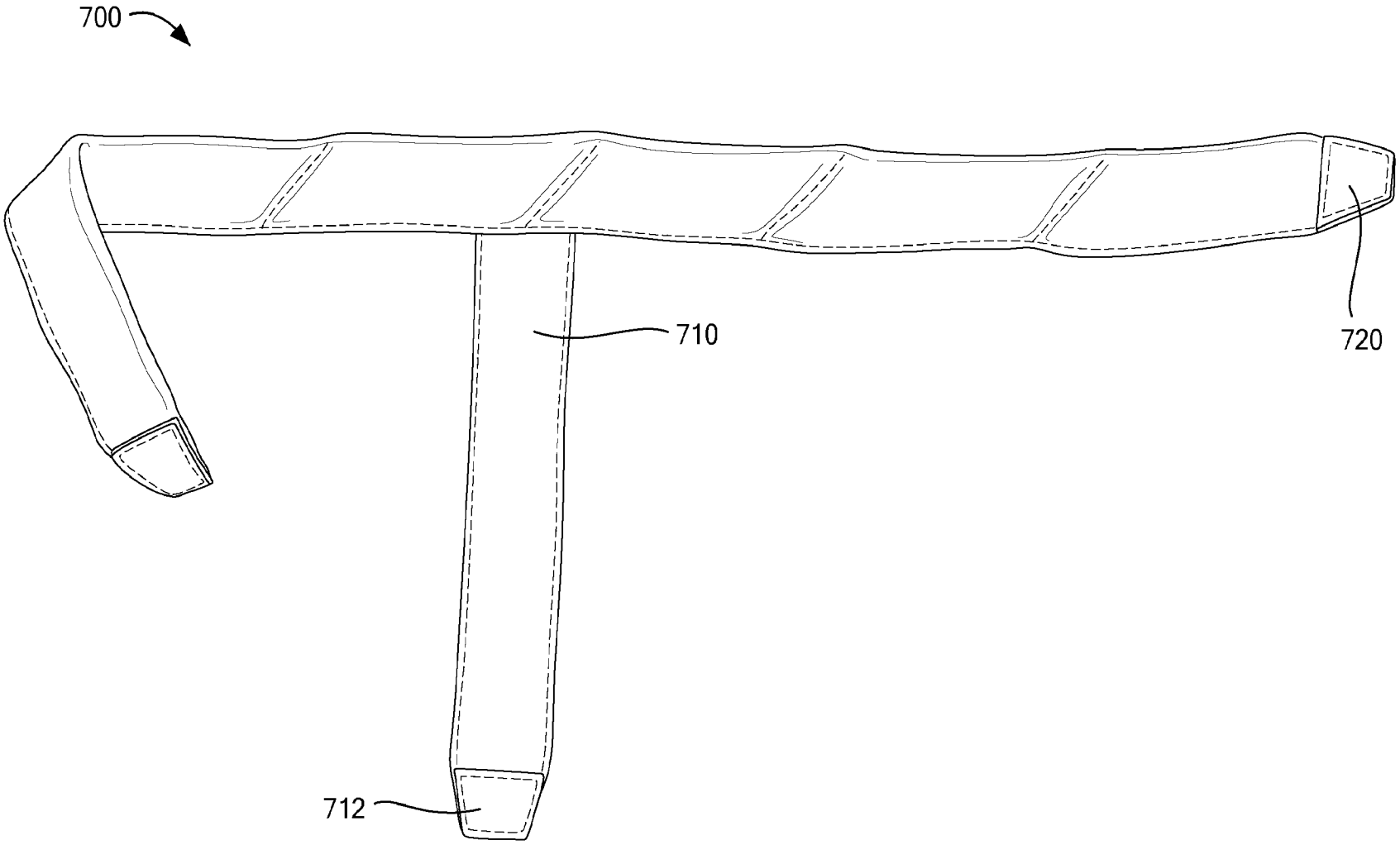
FIGS. 7A-7B are diagrams of a single overhead strap design headband and helmet liner in accordance with one example embodiment disclosed herein.
Figure 7B:
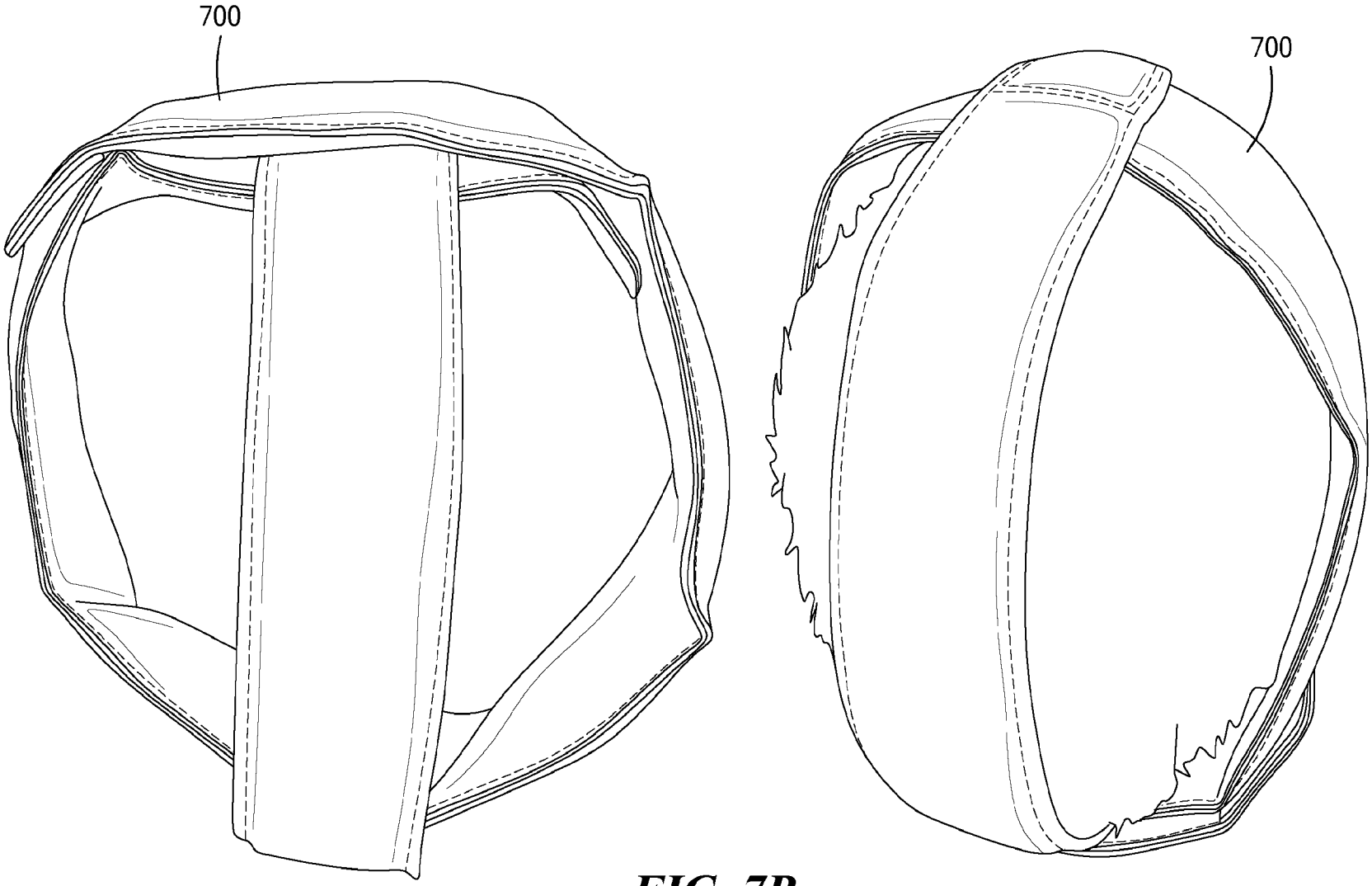

FIGS. 7A-7B show a single "over the head" FEAM employing strap that is fitted to the WAPH base headband structure. This over-head strap is arranged such that it is attached (sewn) to the back part of the WAPH and is Velcro® secured to the front end of the WAPH and attach-positioned so that the Velcro® hook tabs attach themselves to the inner of the Double Fold over sections of the WAPH. For added head impact protection.

Multiple Overhead Strap Configurations

Figure 8:
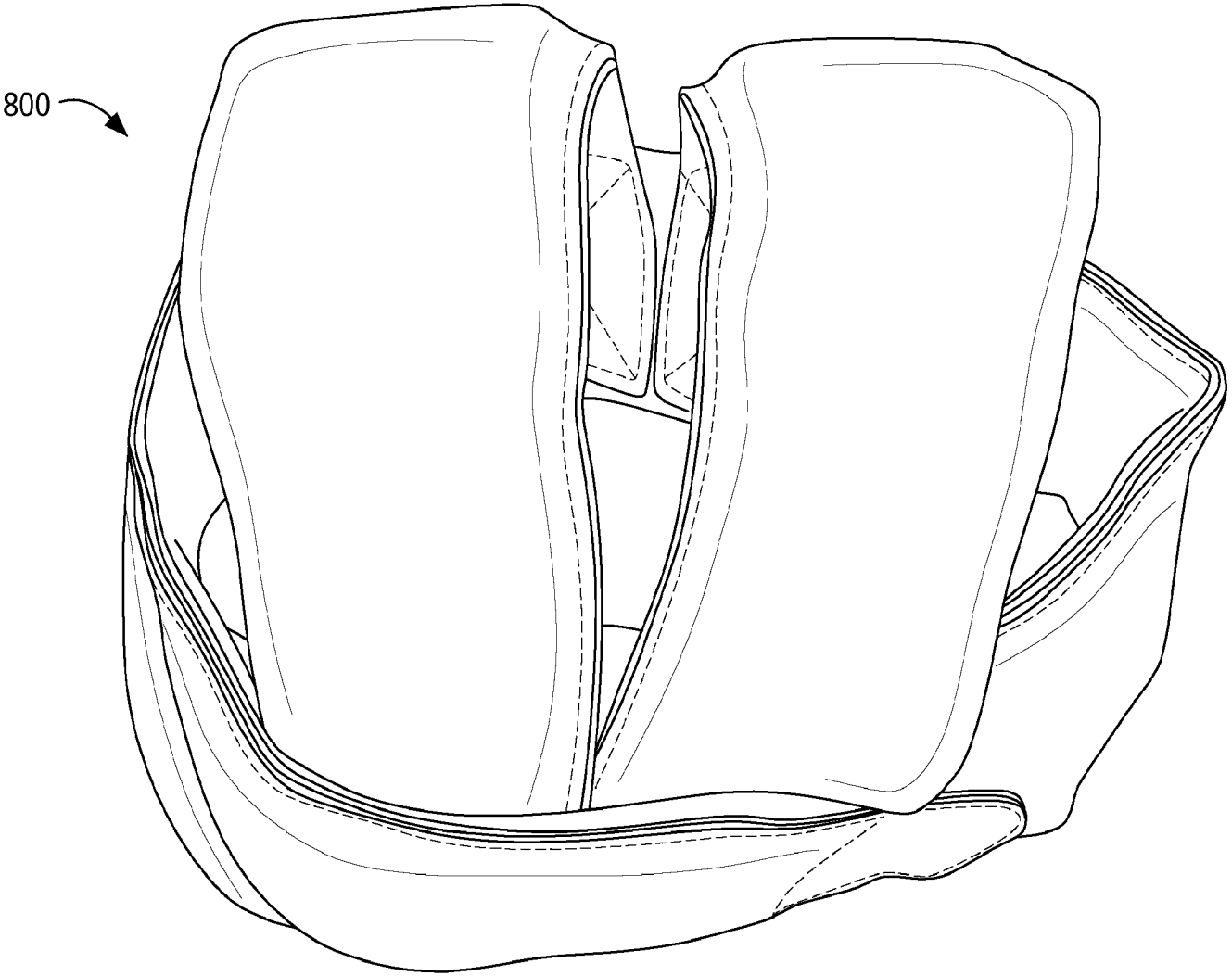
FIG. 8 is a diagram of a double overhead strap design headband and helmet liner for extra IFA protection in accordance with one example embodiment disclosed herein.

FIG. 8 shows a double overhead strap configuration. Fabrication is described for Single Overhead Strap above. This configuration provides extra added head impact protection.

Figure 9A:
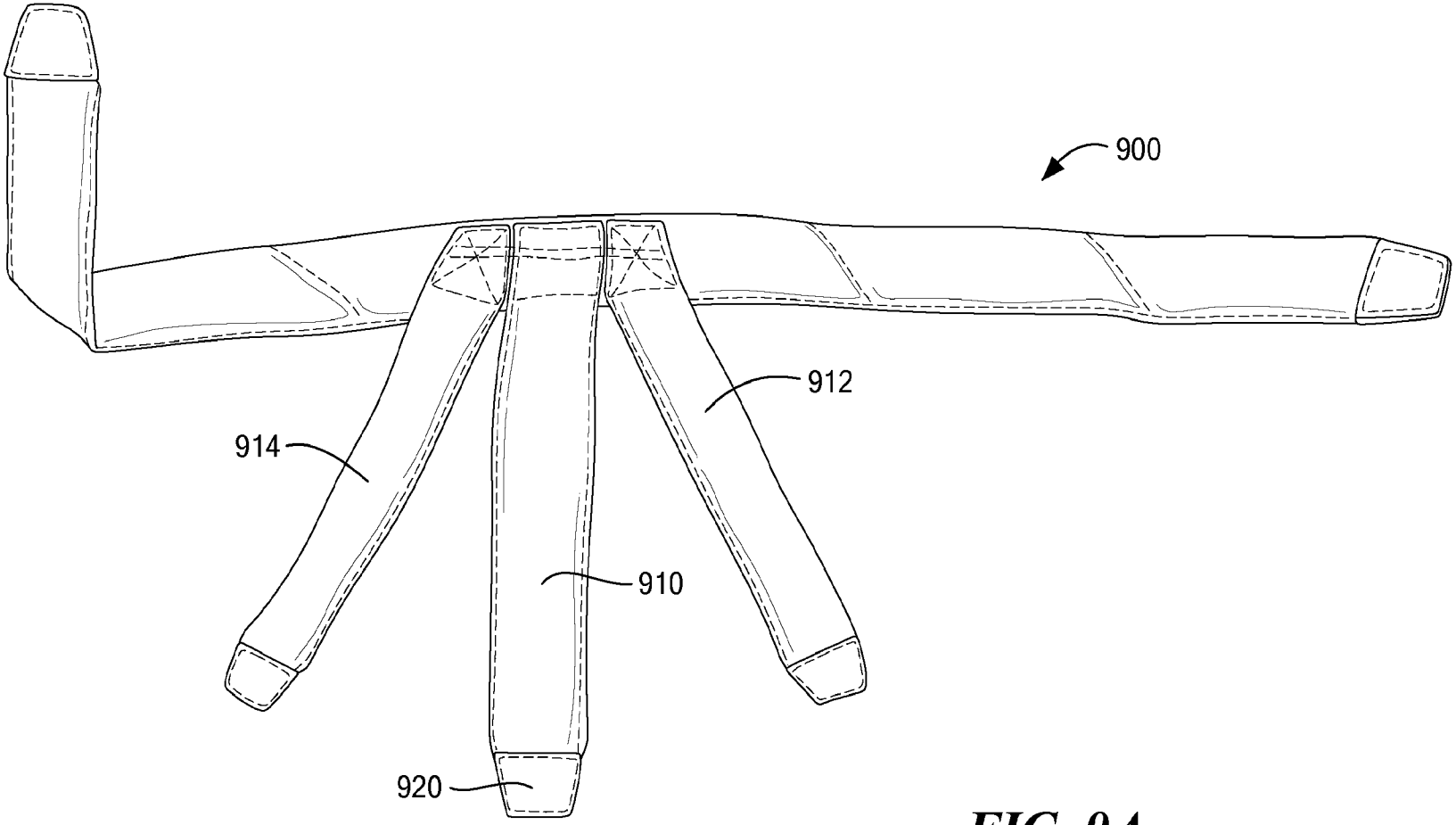
FIGS. 9A and 9B are diagrams of a triple overhead strap design headband and helmet liner designed for optimum IFA headband protection and motorcycle helmet liners in accordance with one example embodiment disclosed herein.
Figure 9B:
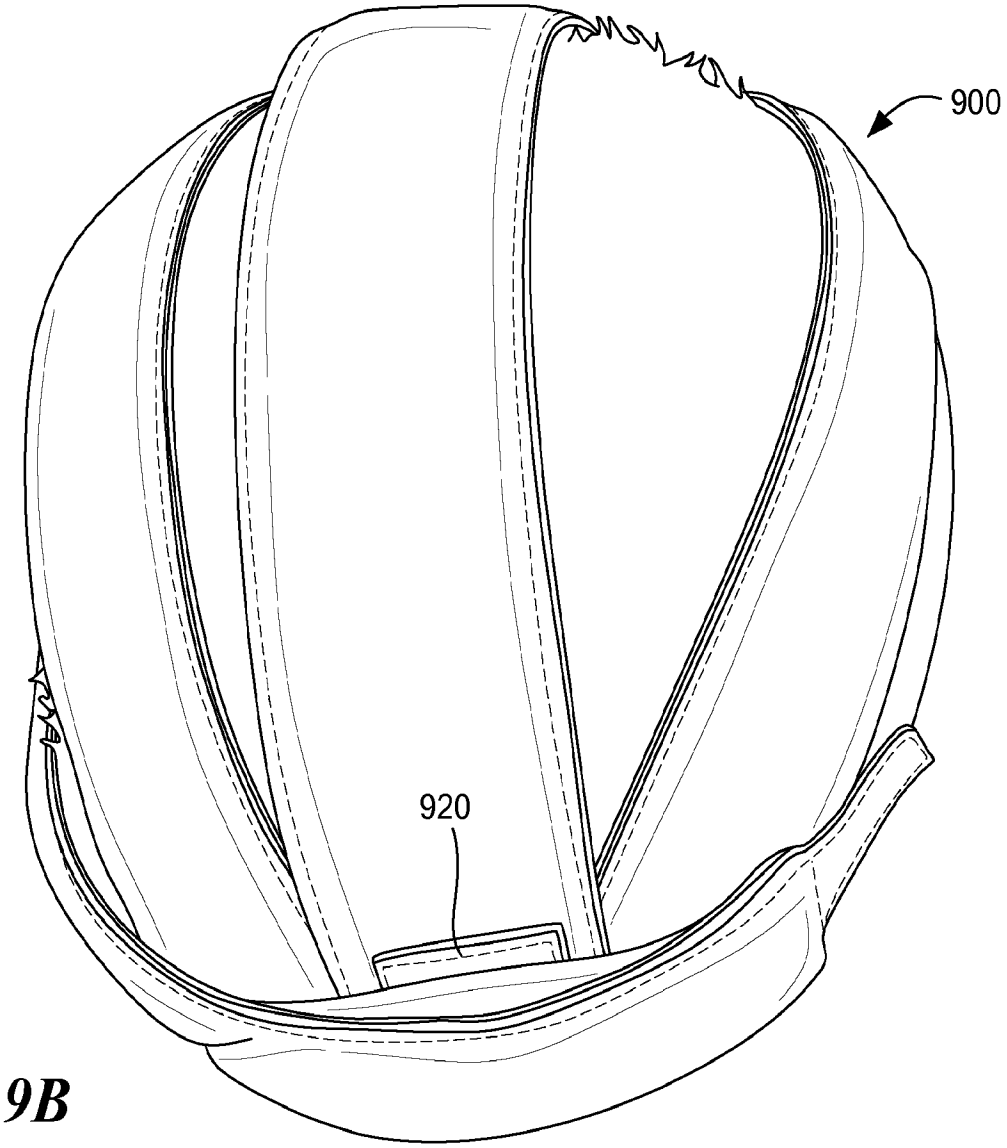

FIGS. 9A-9B show a triple overhead strap design for optimum IFA headband protection and relevant motorcycle helmet liners. Fabrication details are similar to the single and double overhead strap described above. These configurations provide improved added head impact protection.

It should be understood, however, that the foregoing description of the invention is intended to be merely illustrative thereof and that other embodiments, modifications and equivalents may be apparent to those skilled in the art without departing from the principles of the invention.

We claim:

1. A wrap-around impact protecting device comprising:

a plurality of flocked energy absorbing material (FEAM) impact force absorbing (IFA) segments, each segment comprising a double-sided flock section;

a segment cover disposed covering the double-sided flock section; and an outer stretchable elastic fabric cover enclosing the plurality of FEAM IFA pad segments including between-separators segment to keep the segments adjacent to adjoining FEAM IFA pad segments separated.

2. The wrap-around impact protecting device of claim 1, wherein each FEAM IFA pad segment comprises an approximate parallelogram shape; and wherein the separation of the outer elastic cover enclosing the plurality of FEAM IFA segments has diagonal separation corresponding approximate parallelogram shape of the individually enclosed IFA pad segments; and wherein the outer elastic cover includes a closure system for keeping the device adjacent to and securely wrapped around a wearers head.

3. The wrap-around impact protecting device of claim 2, wherein adjacent, proximal ends sides of the approximate parallelogram shape segments are at a 45-degree angle with respect to the diagonal-separated circular assembly of adjacently positioned segments.

4. The wrap-around impact protecting device of claim 1, wherein the double-sided flock sections comprise flock fibers having a denier in a range of about 40 denier to about 100 denier and a length between about 2 mm to about 4 mm.

5. The wrap-around impact protecting device of claim 1, wherein the surface segment cover comprises a microsuede fabric.

6. The wrap-around impact protecting device of claim 1, wherein the impact protecting device is a head-impact protecting device; and further comprising at least one over the head FEAM strap that is attached to a perimeter head-impact protecting base.

7. The wrap-around impact protecting device of claim 1, wherein the segment cover comprises a fabric.

8. The wrap-around impact protecting device of claim 1, wherein the segment separators comprise one of:

stitching;

adhesive bonding; and thermal bonding.

9. The wrap-around impact protecting device of claim 1, wherein the wrap-around impact protecting device perimeter includes a distinctive logo.

* * * * *